US012623135B2

(12) United States Patent
Tarnanas et al.

(10) Patent No.: US 12,623,135 B2
(45) Date of Patent: May 12, 2026

(54) TRAINING ACCESSORY FOR ELECTRONIC DEVICE

(71) Applicant: Teleph0s LLC, Dover, DE (US)

(72) Inventors: Barbara Tarnanas, Houston, TX (US); Antonis Mpadanis, Athens (GR)

(73) Assignee: TELEPHOS LLC, Dover, DE (US)

( * ) Notice: Subject to any disclaimer, the term of this patent is extended or adjusted under 35 U.S.C. 154(b) by 156 days.

(21) Appl. No.: 18/258,785

(22) PCT Filed: Dec. 21, 2020

(86) PCT No.: PCT/IB2020/062271
§ 371 (c)(1),
(2) Date: Jun. 21, 2023

(87) PCT Pub. No.: WO2022/136906
PCT Pub. Date: Jun. 30, 2022

(65) Prior Publication Data
US 2024/0001214 A1 Jan. 4, 2024

(51) Int. Cl.
*A63B 71/06* (2006.01)
*A63B 24/00* (2006.01)

(52) U.S. Cl.
CPC ..... *A63B 71/0622* (2013.01); *A63B 24/0062* (2013.01); *A63B 2071/0627* (2013.01);
(Continued)

(58) Field of Classification Search
CPC ..... A63B 71/0622; A63B 24/0062; A63B 2071/0627; A63B 2071/065;
(Continued)

(56) References Cited

U.S. PATENT DOCUMENTS 7,238,147 B2 7/2007 Mills et al.
10,376,732 B2 * 8/2019 Garsdean ..... A63B 23/03525
(Continued)

FOREIGN PATENT DOCUMENTS

CN 207950442 U * 10/2018
WO 2017202487 A1 11/2017

OTHER PUBLICATIONS

International Search Report and Written Opinion dated Sep. 14, 2021 issued for PCT/IB2020/062271(9 pages).

*Primary Examiner* — Megan Anderson

(57) ABSTRACT

The invention concerns a training accessory for an electronic device and a training method configured to provide training feed-back in real-time. The training accessory comprises a housing suitable for holding the electronic device (400) having a graphical user interface (401), a data interface between the accessory (1) and the electronic device (400), one or more elastically deformable holding means (20), each of said holding means being configured to freely swivel around its attachment point, and one or more sensors (3), including at least a force sensor in the accessory (1), the force sensor being configured to determine the force exerted by the holding means (20). The method includes the steps of determining or receiving a safe training range of an individual user, receiving user training data pertaining to the user's execution of a training exercise in real-time, and based on said user training data calculating corrections in real-time and communicating instructions to the user in real-time to permit the user to correct his execution of the exercise such that the exercise is executed within a safe training range.

16 Claims, 5 Drawing Sheets

Figure 1A:
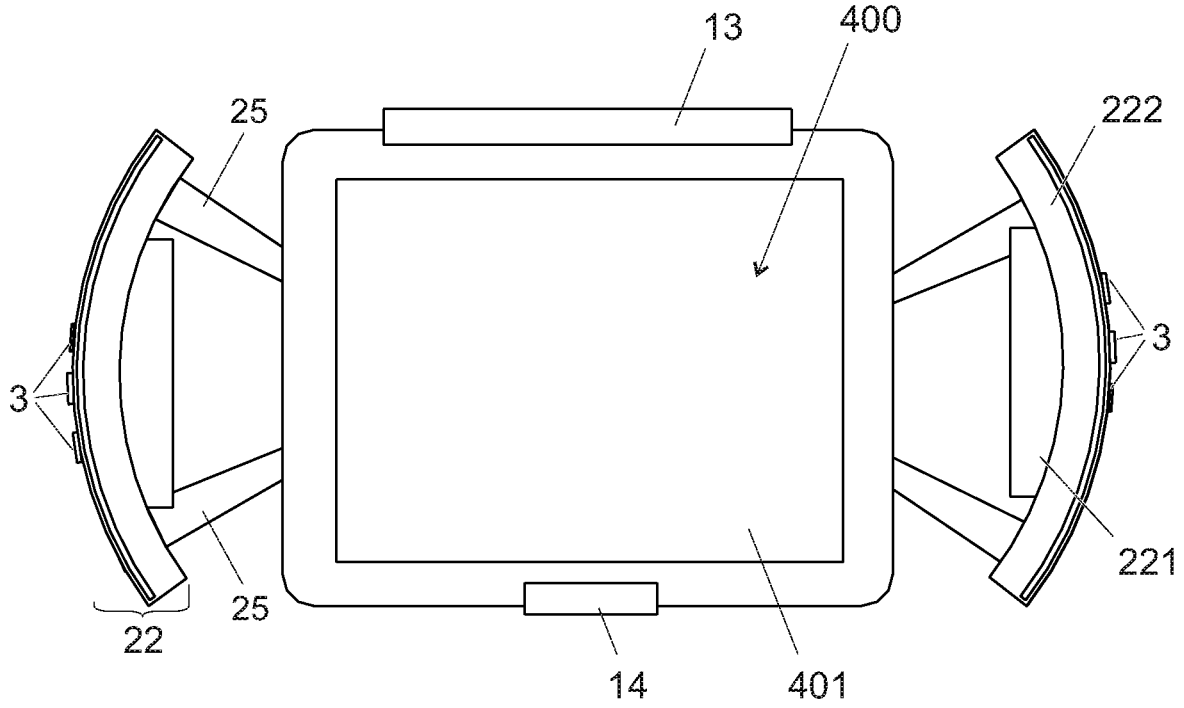

(52) U.S. Cl.
CPC . *A63B 2071/065* (2013.01); *A63B 2071/0655* (2013.01); *A63B 2220/34* (2013.01); *A63B 2220/40* (2013.01); *A63B 2220/50* (2013.01); *A63B 2220/836* (2013.01); *A63B 2225/02* (2013.01); *A63B 2225/50* (2013.01); *A63B 2230/062* (2013.01); *A63B 2230/655* (2013.01)

(58) Field of Classification Search
CPC ..... A63B 2071/0655; A63B 2220/34; A63B 2220/40; A63B 2220/50; A63B 2220/836; A63B 2225/02; A63B 2225/50; A63B 2230/062; A63B 2230/655; A63B 21/00065; A63B 21/06; A63B 2024/0068; A63B 2071/068; A63B 2209/08; A63B 2220/16; A63B 2220/30; A63B 2220/62; A63B 2230/42; A63B 2230/65; A63B 21/00189; A63B 21/0552; A63B 21/00196; A63B 2220/51; A63B 2225/20; A63B 2230/06; A63B 71/06; A63B 71/0619; A63B 71/0669; A63B 21/00043; A63B 21/00061; A63B 21/02; A63B 21/05; A63B 21/055
See application file for complete search history.

(56) References Cited

U.S. PATENT DOCUMENTS

| | | | | |
|---|---|---|---|---|
| 2012/0184418 | A1 | 7/2012 | Wilson | |
| 2017/0036063 | A1* | 2/2017 | Goldston | A63B 71/0622 |
| 2018/0214755 | A1* | 8/2018 | Villalba | A63B 67/08 |
| 2019/0255374 | A1* | 8/2019 | Constanza | A63B 24/0087 |
| 2020/0023229 | A1* | 1/2020 | Oltorik | A63B 24/0062 |

* cited by examiner

TRAINING ACCESSORY FOR ELECTRONIC DEVICE

RELATED APPLICATION

This application is a national phase of International Application No. PCT/IB2020/062271, filed on Dec. 21, 2020. The entire disclosure of which is hereby incorporated by reference.

TECHNICAL DOMAIN

The present invention concerns an accessory for a handheld electronic device and a method for performing and adjusting physical exercise.

RELATED ART

Training experience and effectiveness for a user can be significantly enhanced by providing a tailored feed-back to the user on his performance of a training exercise. This is widely recognized, and training systems conventionally include sensors and processing units to determine user performance and/or physical parameters of the user.

Safe performance of training exercises is of particular importance for persons with impaired physical capabilities, such as users with reduced neurological function or elderly people. For this group of individuals, an incorrectly executed exercise can very rapidly have damaging consequences. Due to the weakened or imbalanced muscular system of these individuals, even small, repeated errors in the performance of an exercise, or overperformance of an exercise may result in an injury.

Individuals with reduced physical capacity require a training system, which allows them to perform training exercises safely in order to achieve the desired effect and a positive training outcome. Such reduced physical capacity may for example be due to muscle atrophy, neurological dysfunction or a physical weakness due to an injury.

In addition, individuals with impaired cognitive function often face difficulties in performing physical exercise accurately according to the given instructions. As a result, the exercises may be performed incorrectly and can lead to adverse effects or, at a minimum, not be effective.

In the prior art several systems and approaches have been described for collecting and analyzing user training data and providing a feed-back of the user's overall performance. However, conventional systems merely collect and display user data without providing the user with useful advice as to how to correctly and safely perform a given exercise. Such conventional systems are not particularly suited for users with reduced physical, cognitive, and neurological function.

WO2017202487A1 discloses a training device assembly for detecting physical performance values of a test subject, with a force sensor and an evaluation unit. The force applied to the force sensor by the test subject can be indicated on a display of the evaluation unit. The device includes further sensors, such as a body fat sensor. The evaluation unit contains a microcontroller (MCU) for evaluation of the values determined by the sensors. The system does however not teach how to adjust the execution of a particular training exercise performed by the user on the training device.

U.S. Pat. No. 7,238,147B2 describes a handheld exercise device with a housing, a pair of rotatable handle assemblies within the housing, and a cavity within the housing for receiving one or more removable weights. The weights can be adapted according to the preferences and capabilities of the user. The system does not provide feed-back to the user on his performance of the exercise.

U.S. Pat. No. 7,238,147 discloses an apparatus for physical exercise with a handle and vibrating means, which are coupled to said the handle and connected to a processing and controlling device, which is used to set a vibration frequency of the vibrating means. The apparatus provides mechanical neuro-muscular stimulation produced through the mechanical vibrations exerted through the handle. The device does not provide feed-back on the correct execution of a training exercise.

US2018214755 concerns a set of juggling modules with cohesive handles, which can be attached to a fastening system on the juggling module. The handles are connected to links, which provide the physical connection between the juggling module and other juggling modules, respectively props, such as to result in an interconnected set of juggling modules.

US2017036063 describes an exercise apparatus with two cords, which are both pullable and retractable around a pully mechanism, which is disposed inside the apparatus.

US2020023229 discloses a portable strength training apparatus comprising a platform base with a plurality of base attachment mechanisms. Resistance bands can be removably attached to one or more base attachment mechanisms.

US2017036063 concerns a portable isotonic compression-expansion exercise device. The device may comprise an elastomeric, resilient ball with a detachable, removable and interchangeable exterior resistant band with two opposing handles.

None of the approaches provided today provides a satisfactory training system tailored around an individual user's physically, neurologically and/or cognitively capability and weaknesses, such that the training can be performed safely with minimal risk of injury or damage.

The present invention sets out to find a solution to enable people with reduced, physical, neurological and/or cognitive function to perform training exercises safely and effectively. Preferably, the solution should be convenient to use, readily accessible, i.e. able to be performed at home or elsewhere, and require minimal intervention by a human training supervisor, such a s a physiotherapist.

SHORT DISCLOSURE OF THE INVENTION

It is an aim of the present invention to present a training system capable of providing instant feed-back to the user regarding his correct execution of a given exercise.

It is another aim of this invention to find a training system which is capable of providing targeted instructions to the user as to how a given exercise can be corrected, in order to avoid adverse training effects.

Preferably, the system should be portable and easy to use.

It is yet another aim of this invention to find an alternative to existing training systems.

According to the invention, one or more of these aims are attained by the object of the attached claims, and especially by the independent claims.

In particular, one or more of these aims are achieved by an accessory for an electronic device with a graphical user interface comprising

- a housing suitable for holding the electronic device,
- a data interface between the accessory and the electronic device,
- one or more, preferably two elastically deformable holding means, with a first portion for holding and a second, elastically deformable portion, wherein the elastically deformable portion of each holding means is attached to the housing, and one or more sensors including at least a force sensor in the accessory, the force sensor being configured to determine the force exerted by the holding means, wherein each holding means can freely swivel around its attachment point.

The aims are achieved furthermore by a method for adjusting physical exercise to physical capabilities of users with reduced physical capabilities using the accessory described above, comprising determining or receiving a safe training range, receiving user training data pertaining to the user's execution of a training exercise in real-time, and based on said user training data calculating corrections in real-time and communicating instructions to the user in real-time to permit the user to correct his execution of the exercise such that the exercise is executed within a safe training range.

Preferably, the method includes a calibration step to determine the safe training range, comprising defining a calibration exercise to be performed by a user on the training accessory, receiving user calibration data pertaining to the execution of the calibration exercise by the user, defining a user profile based on the user calibration data or refining a predetermined/predefined user profile based on the user calibration data, defining a safe training range based on user calibration data for the individual user profile.

The training accessory disclosed herein is a portable device and is therefore extremely convenient to use. No particular training surrounding is required. The user is self-sufficient in his training, as he can rely on the accessory in combination with the electronic device to provide an instant and/or continuous feed-back regarding the training performance. Moreover, the user can, optionally, also avail of a suitable training program, which is tailored around his specific needs and wishes based on predetermined parameters and/or his previous performance of an exercise. No additional screen or physical connection to other devices is required for performing a training exercise or a training program.

The training accessory and/or the method enable real-time feed-back to the user regarding his performance of the exercise. Corrections of the user's execution of a given exercise and/or other information may be communicated to the user by means of the electronic device, for example through its graphical user interface (GUI). Such corrections and/or other information may also be conveyed through the accessory, for example through the holding portions of the holding means or the housing. Information may be conveyed by both, the electronic device as well as the accessory.

Preferably, the data interface between the accessory and the electronic device is suitable for bi-directional communication of data. The electronic device is set up to receive input data, such as, for example, data pertaining to forces executed through the holding means, from the accessory.

Ideally, the electronic device is also configured to transmit output data, for example pertaining to instructions for the user, to the accessory through the bi-directional data interface. Real-time communication between the accessory and the electronic device offers the advantage that the user receives instructions in while performing the exercise. The user can therefore correct any mistakes in his performance immediately. As a result, the risk of training-related injuries is reduced. At the same time, the effectiveness of the training is enhanced, as the immediate feed-back enables the user to perform the exercises correctly to their maximum effect.

In order to provide real-time feed-back to the user, the accessory in combination with the electronic device are equipped with one or more suitable processors for receiving and processing input data in real-time. The processor may be entirely contained in the electronic device. The processor may also be comprised in the accessory. Both, the accessory and the electronic device, may have individual processors. Such individual processors should be capable of exchanging data and communicating with each other through the bidirectional communication protocol.

The accessory may have means to attach mountable weights. Such means may be locking means suited for fixing weights to the housing of the accessory. Such means may also be magnetic portions of the housing, to which weights can be attached magnetically. The weights can be adjusted according to specific training requirements.

The training method described in this invention may also be configured to provide feed-back in form of advice to the user regarding weights to be mounted and/or distribution of weights. Such advice may advantageously be based on, amongst others, the user profile, the user safe performance range and/or the user's desired training result.

Advantageously the accessory comprises a suitable number of holding means for training. Two holding means can be chosen, when the accessory is operated by the left hand and the right hand of the user for example. However, the holding means may also be operated by the user's legs, for example, by inserting a foot into the holding portion of the holding means. One holding portion of the accessory may also be fixed statically, for example by means of a hook on the wall. In this example the training may be focused on one arm or leg of a user. Other combinations and training options are possible.

User profiles can include profiles for individual limbs to be trained. A profile for the user's right leg may for example be very different for a profile for the user's left arm.

In addition, several user profiles for different users can be defined. The profiles can be defined on the basis of real user input data, such as calibration data or training data. User profiles may also be pre-programmed. Predetermined user profiles may for example be created or adjusted by medical professionals, physiotherapists, or other training advisors. One or more user profiles can also be predetermined and subsequently refined in real-time based on the user input data, for example as part of the calibration step and/or training phase.

The elastically deformable holding means can come in different forms and materials according to their intended mode of functioning.

The elastic portion of the holding means may for example be stretchable bands suitable for pulling exercises. The elastic portion may however also be adapted to receive a pushing force. The elastic portion may furthermore be designed to be squeezable.

Force sensors to determine the force applied through the holding means, should be located in suitable positions. Force sensors may for example be comprised in the stretchable bands of tensile holding means, which are a preferred embodiment. Force sensors may also be integrated in the holding portion, such as to determine the strength of a user's grip on the holding portion.

The accessory may advantageously comprise further sensors. Such sensors may for example be sensors to determine physiological parameters of a user, for example a heart rate sensor, a stress sensor, a body fat sensor, and/or other sensors. The invention is not limited to particular types of sensors, or a particular combination of sensors. Sensors can, for example, be positioned in the holding portion of the holding means.

Preferably, each holding means has a separate attachment point on the accessory.

Each holding means can freely swivel around its attachment point.

In a preferred embodiment, the accessory is held by means of the holding means only, such that the spatial movement of the accessory results solely from the sum of forces exerted through the holding means, provided such sum is not equal to zero. The spatial movement can be described as being composed of a translational and/or a rotational movement.

The attachment points may be contained within structural attachment elements, which may further comprise a servo mechanism for providing force feed-back to the user. Such structural attachment elements may be physically connected in such a way that the dynamics of force feed-back to the holding means, and/or the movement of the holding means is linked. The physical connection between the structural attachment elements may be adjusted mechanically or by means of a computer program.

The movement of the accessory and the electronic device can be determined by a suitable sensor comprised in the accessory and/or the electronic device. Such suitable sensors may be a gyroscope and/or an accelerometer.

The data collected on the spatial movement of the device can be used to determine the user's performance of the exercise. For example, it can be determined if the actual movement of device corresponds to the theoretical movement the device should perform, if a proposed predetermined exercise is executed correctly. The actual movement of the device during a training exercise constitutes a type of user input data, such as user training data or user calibration data.

The same principle of evaluating correct performance can also be applied to other types of user input data. In short, actual user input data can be compared to predetermined target values for a chosen exercise. A discrepancy between the user input data and the target values indicates incorrect performance of the exercise. The discrepancy may also indicate the limits of the user's capabilities. This information of the user's capabilities may be used to determine or to refine a user profile and/or a safe training range for the user.

User input data, such as calibration data and training data, may for example be compared with pre-programmed parameters such as motion smoothness, motion speed and/or agility.

Motion smoothness as used herein is a measure of how smoothly the movement/exercise is executed. By way of example, this may relate to fluctuations in the level of the grip strength in relation to the movement of the accessory and electronic device. It can be expressed as a ratio of the grip strength over the speed of movement of the accessory.

Motion speed as used herein is a measure for speed of movement of the accessory as provided by gyroscope and/or accelerometer data. The calculation of the motion speed is based on the assumption that a user's motion speed decelerates at the limits of the execution angles of a suggested exercise. The limits of the execution angles are predetermined or can be adjusted according to the performance and/or capability of the user. The degree of deceleration at said limits can be calculated in relation to the user's grip strength. Values obtained for motion speed within the limits can then be compared to the values obtained for motion speed at the limits or outside the limits. If a user displays a reduced grip strength at the limit but continues to perform the exercise at high speed, a warning signal may be triggered to alert the user of unsafe performance.

Motion agility as used herein is an indicator of how easily the user can change the direction or speed of execution. Motion agility can also be correlated with the grip strength. The acceleration from the portable main electronic device's gyroscope in relation to changes in direction and to get the ratio again in relation to the grip strength. The ratio could for example be defined in different categories, such as very low, low, mid, high, or very high.

An individualised user safe training range may be determined as part of the calibration step. The user safe range may be refined and/or re-calibrated in real-time during the user's training based on the user training data.

The data are collected and processed in real-time. Preferably, user data are collected at high frequency. The term high frequency as used herein signifies a sampling frequency of at least 100 Hertz.

Based on the user input data, which may be user training data or user calibration data, corrections are calculated in real-time. Instructions as to how to adapt the execution of the exercise are then communicated to the user in real-time to permit the user to correct the exercise while performing it. The user can thus perform the training safely and within his individual safe training range.

The device is configured to provide a real-time feedback to the user. Such feed-back may be communicated visually, acoustically and/or in a tactile manner through the electronic device alone or through both, the electronic device and the accessory.

The GUI of the electronic device may for example display information visually in form of colours, arrows and/or other shapes to guide the user in the exercise. Specifically, the information displayed may, by way of example, advise on the correction of the pull force applied, the pull direction, the extent of the movement, and so on. The accessory may include lights which can act as warning lights or indicate a direction of movement, and/or a force exerted on the device.

Instruction and information may be conveyed acoustically, be it verbally or in form of sounds or sound patterns. Moreover, instructions and information can be communicated through tactile cues, for example vibrations.

Advantageously, the accessory in combination with the electronic device can be configured to provide instructions to the user in respect of each extremity operating a holding means. The customised feed-back therefore also serves to improve the coordinated movement of the user extremities, i.e. the user's arms and/or legs.

Preferably, at the end of a training session the user will receive a summary of his performance. The training results can be stored and may be analysed using a suitable program. The data may be stored in a remote server, for example a cloud server. The results may subsequently be shared with a training supervisor, such as a training instructor, a physiotherapist or medical professional. The training supervisor can further evaluate the results and, if needed, consult with the user on next steps.

In addition, a suitable training exercise or a training program may be calculated for an individual user. The recommended exercises are preferably based on the user profile and the safe training range to ensure that the suggested exercise suit the abilities and weaknesses of the user.

The presented system enables a very precise analysis of training performance in real time, which allows for the detection of micro-errors. In addition, the method may also be configured to provide a summary of the user's performance at the end of an exercise or an exercise program.

The disclosed device and method are therefore particularly relevant for users of reduced physical and/or neurological function, like elderly users or users recovering from injury, as they will be able to perform physical exercises in a guided, correct and safe manner.

The parameters and the structure of the process including its real-time feedback loops and customized safe training ranges allows for adaptation training to individual limits of people with reduced mobility and/or reflexes, or people having specific physical weaknesses. As such the training device and method can be readily integrated into a physiotherapy program or a larger treatment plan.

The method may furthermore comprise a computer program which is performed on a processor comprised in the electronic device and/or the accessory for analysing user input data and generating output data for communication of information to the user according as intended in the claimed method. The computer program may be based on artificial intelligence algorithms, using user input data to train the algorithm. Such computer program may be provided in form of a computer program product which can for example be downloaded on the internet.

SHORT DESCRIPTION OF THE DRAWINGS

Figure 1B:
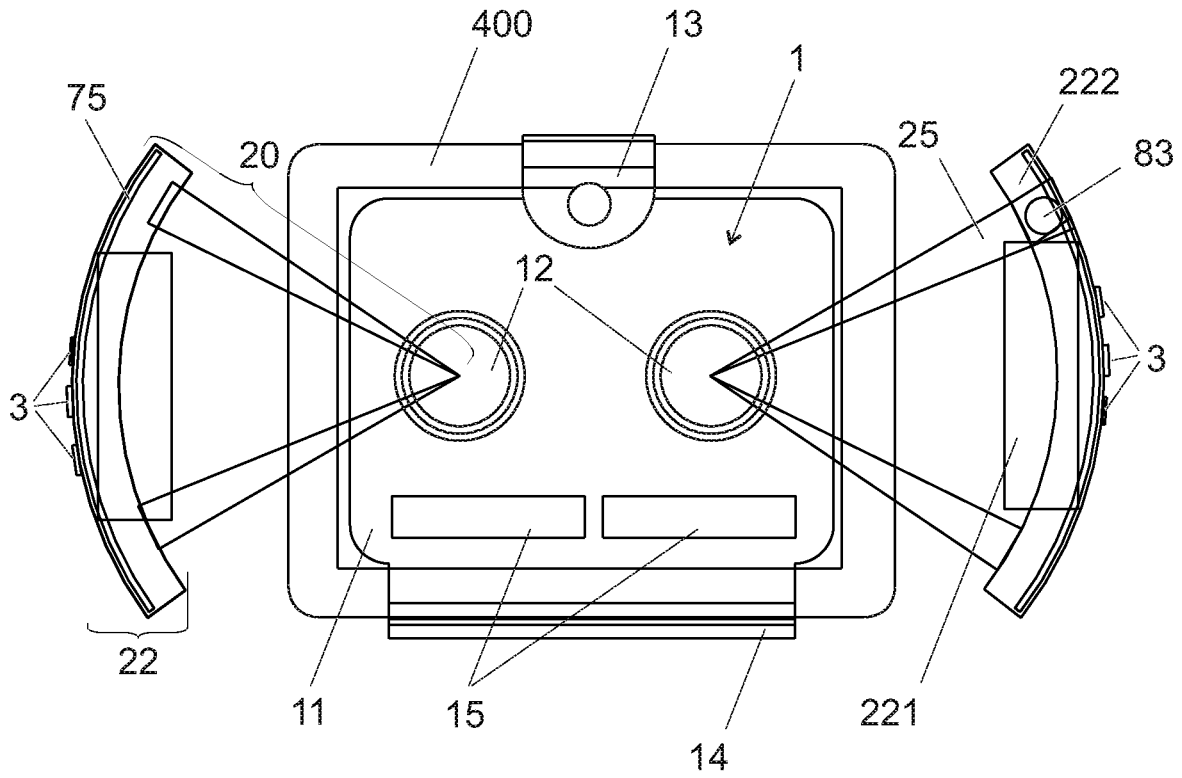
Figure 1C:
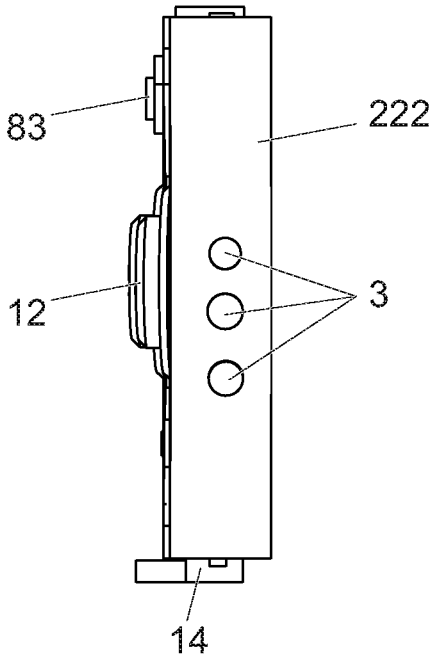
Figure 1D:
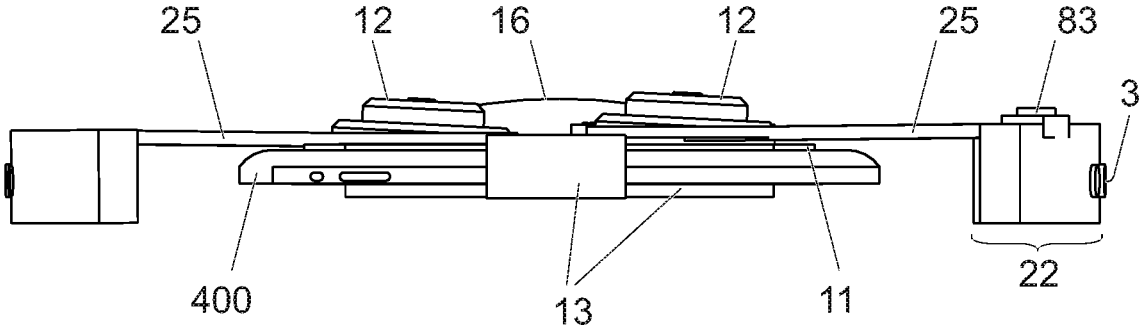
Figure 2:
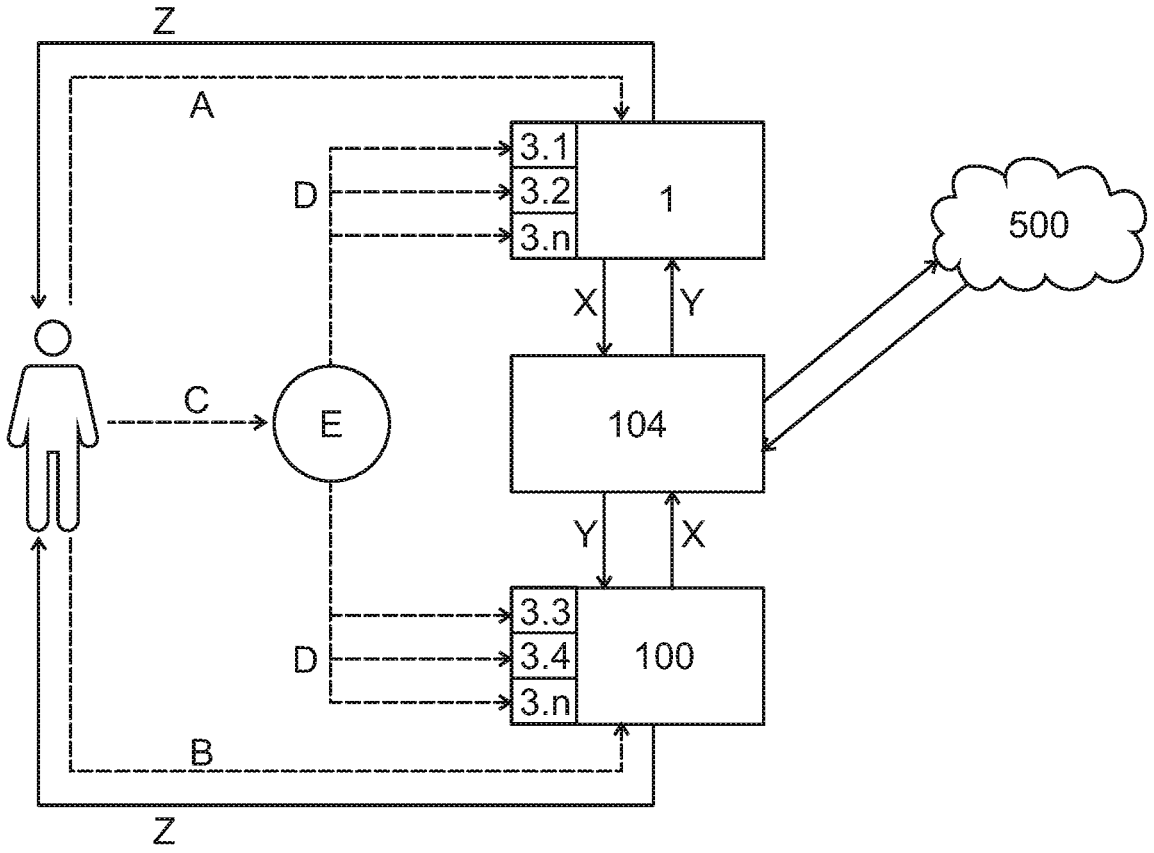

Exemplar embodiments of the invention are disclosed in the description and illustrated by the drawings in which:

FIG. 1A depicts a schematic front view of a preferred embodiment of the training accessory, FIG. 1B depicts a schematic back view of a preferred embodiment of the training accessory, FIG. 1C depicts a schematic side view of a preferred embodiment of the training accessory, FIG. 1D depicts a schematic top view of a preferred embodiment of the training accessory, and FIG. 2 depicts an operational mode diagram of a preferred embodiment of the claimed.

EXAMPLES OF EMBODIMENTS OF THE PRESENT INVENTION

A preferred embodiment of the training accessory 1 is schematically shown in FIGS. 1A to 1B. The accessory comprises a housing, in which the electronic device 400 is mounted. The electronic device 400 has a graphical user interface ("GUI") 401, preferably a tactile screen. Information and/or instructions for the user can be displayed on said GUI 401. Moreover, the user can enter information, data or adjustments of settings by means of the user interface. The housing in this embodiment has a rectangular back wall 11 with a left and a right attachment point comprised in attachment elements 12 positioned on the horizontal line of symmetry of the back wall. The housing shown herein furthermore has an upper retaining means 13 and a lower retaining means 14, which are arranged for holding the electronic device 400. In the example shown in FIGS. 1A to 1D the retaining means are brackets. The electronic device 400 is preferably removably inserted between the upper and the lower holding brackets 13, 14.

It is clear, that the housing is not limited to this preferred embodiment, but it can take different shapes and forms suitable for holding the electronic device 400. The housing may for example also comprise one to four side walls in addition to the backwall.

Preferably the dimensions of the housing device are fitted to the dimensions of the electronic device 400. The dimensions of the accessory are such that the electronic device can be securely fastened to the accessory 1, preventing it from disengaging from the accessory 1 during the performance of an exercise. To this end, suitable structural elements, such as the upper and lower brackets 13, 14 in this preferred embodiment, are comprised in the accessory 1.

In order to enable the use of the accessory 1 with different sizes of electronic devices 400, depending for example on the manufacturer or the type of device. It is for example possible to include structural features to adjust the dimensions of the housing in order to suit the dimensions of the device. Different adjustment mechanisms, such as extendable elements of the housing, such as the brackets, are thinkable. Such extendable elements should be capable of being fixed in a desired position, respectively at a desired length. Other suitable mechanisms are possible.

Although the preferred shape of the housing is a rectangular shape, the invention is not limited to this shape.

The housing 11 shown in FIG. 1B furthermore comprises two magnetic areas 15 each positioned between one of the two attachment elements 12 and the lower bracket 14. The magnetic areas 15 are intended for fastening weights comprising ferromagnetic material to the back wall 11 of the housing. Other means for fastening weights are possible. Such other mechanism may for example be a locking mechanism which locks weights to the housing.

Preferably, the accessory includes means or portions for attaching two weights on its back wall 11, one to the left and the other one to the right of the geometrical centre of the back wall 11 of the accessory. This is the preferred arrangement for an accessory adapted to be manipulated by the left and the right hand of the user. However, it is also possible to attach either more weights or less weights on different positions on the accessory.

The weight attached to the left or the right magnetic area 15 may be chosen according to the user's training needs and/or physical abilities. The weight chosen for one side does not have to be identical with the weight chosen for the other side. For example, a weight of 300 g may be chosen for the left hand, while a weight of 100 g may be chosen for the right side. Recommendations pertaining to suitable weights to be attached to the left and the right magnetic area can for example be provided on the basis of the user profile determined by the claimed method and communicated through the graphical user interface 410 of the electronic device 400.

This preferred embodiment is operated by the left and right hand of the user holding a left and a right holding means 20. Each holding means 20 shown in this embodiment comprises an elastic portion, specifically a portion comprising two elastic bands 25. The elastic bands 25 are pivotably attached to an attachment point on one end and to a handle 22 for gripping on the other end. The handle 22 is the holding portion of the holding means 20. The two bands 25 of the left holding means are attached to the left attachment point and the two bands 25 of the right holding means are attached to the right attachment point.

The handle 22 of this embodiment has a convex curved part 222, which resemble a section of a steering wheel. In this preferred embodiment one elastic band 25 is attached to either end of the curved part 222. The handle 22 furthermore comprises a grip part 221, which is designed to improve the ergonomics of the handle. The user holds the handle in the middle portion of the curved part 222 to which the grip part 221 is fixed on the inside of the curvature. The outer side of curved part, which connects with the palm of the user's hand when held, furthermore may comprise one or more sensors 3 for measuring physical parameters of the user, such heart rate, pulse, force of the grip, galvanic skin response or other electrodermal responses, and others.

Further sensors may be included in the holding means and integrated at suitable positions. A force sensor, which is an essential element of the accessory, may for example be positioned in the elastic bands 25 in order to determine the force exerted by the user through each band 25.

The holding means preferably furthermore comprise a an on/off button 83. The on/off button serves to activate the electronic components of the accessory.

In this preferred embodiment the attachment elements 12, which comprise the attachment points of the holding means 20, can tilt in relation to the plane of the back wall 11 of the housing. The tilt may be induced in the direction of the movement of and/or by the force enacted on the holding means 20. Preferably the structural elements of the attachment elements 12 are connected, for example through a bridging connection 16, such that the dynamics of their tilting movements are joined. In other words, the bridging connection 16 may be configured to cause the two attachment structures to perform their tilting movement synchronously.

The bridging connection 16 may actively be adjusted, either mechanically or by means of a computer program, in response to the user's specific capabilities and/or the different forces the user exerts on each holding means 20. The bridging element 16 may furthermore be arranged to adjust the attachment elements 12 according to the instructions received by the computer program. The accessory 1 can thus be kept in a centred position despite an imbalance of force. This may for example be useful, if the strengths of the user's arms are largely different, for example as a result of an injury.

The two independent attachment elements 12 may optionally comprise a servo mechanism which corrects the performance of the exercise, for example in form of an active force feed-back. Preferably the servo mechanism is dynamically adjusted by means of a computer program. The preferred parameters of the servo mechanism may also be predetermined, respectively pre-programmed.

The holding means presented in this embodiment are a preferred example for a training accessory operated by the user's hands. However, other executions of holding devices are possible. The elastic part of the holding device may for example be suited to receive a push force rather than a pull force. The elastic portion may also be a portion suited to receiving a squeezing force. It may also be suited to receive a combination of these forces. The shape, composition and/or suitable material of the elastic portion will vary according to the intended mode of operation.

The holding portion of the holding means may also take different forms and does not have to be a curved handle. The holding portion may be suited to be gripped by a hand. It may also have a shape, for example a loop, suited to be fastened to a foot. Other variations are possible.

The accessory comprises a data interface, preferably a bi-directional data interface with the electronic device. Such data interface may be a physical connection point suited for transmitting data. The data interface may also be a means enabling wireless communication, for example means configured for Bluetooth communication or wireless network protocols.

As mentioned, the accessory comprises a at a least one force sensor. The accessory and/or the electronic device mounted in the accessory may comprise further sensors for detecting the movement of the device, such as a gyroscope and/or an accelerometer.

FIG. 2 presents schematically a preferred embodiment of the claimed method. Solid arrows indicate flow of data and/or instructions X, Y, Z, while dashed arrows indicate actions A, B, C, D.

While preforming the exercise E, the user holds the accessory 1 with the mounted electronic device 400. User input data are processed by one or more controllers, respectively processing units 104, which generate output data in real-time, including instructions for the user Z. The processor 104 may be comprised in the electronic device 400 only. It is also possible that both, the electronic device 400 as well as accessory 1 include controller units 104. Data are preferably exchanged between the accessory 1 and the electronic device 400 through a bidirectional communication protocol.

The one or more processor 104 can receive X user input data through the sensors 3.1, 3.2, **3.*n* of the accessory 1, and/or the electronic device 400. User input data can be entered into the electronic device through the sensors 3.3, 3.4. 3.*n* and/or a GUI 401**.

Sensors may for example measure physiological parameters of the user, such as heart rate, pulse, respiratory rate, and others. These sensors are preferably comprised in the handle 22 of the accessory 1. The accessory furthermore comprises a force sensor. Additional sensors pertaining to the evaluation of the motion performed by the user, such as a gyroscope or an accelerometer, are preferably comprised in the electronic device. However, said sensors determining the motion may also be comprised in the accessory.

The one or more processor calculates output data which is transmitted Y to the accessory 1 and/or the GUI of the electronic device 400.

Information and/or instructions is conveyed z to the user by means of the electronic device 400 and/or the accessory 1. Preferably information and/or instructions are displayed on the GUI 401 of the electronic device. Information and/or instructions for the user can also be conveyed by means of the accessory 1, for example in form of an acoustic or verbal instruction, in form of a tactile feed-back, such as a vibration, and/or by visual means, such as light signals emitted for example by an LED light strip 75 comprised in the accessory (FIGS. 1A, 1B). Light signals may be a pattern of colours and/or sequence in time of the emitted light.

The instruction should be conveyed in a user friendly, adequate manner. It can, for example be an arrow with a short, written statement, such as "pull more on right" displayed on the GUI. For some user groups acoustic or tactile signals may be the preferred option. Preferably, the mode of communication of said instruction can be determined by the user.

The user executes C the exercise E according to the instructions. Based on his operation of the accessory D information pertaining to the execution of the prescribed exercise and the user's physiological parameters is received through the sensors 3.1, 3.2, 3.3, 3.4 **3.*n***.

In addition, the user may adjust A certain settings or features of the accessory according to the received instructions. For example, the user may attach weights on the accessory 1. The user can also enter information, specific settings and/or preferences B by means of the GUI of the electronic device 400.

The method as provided herein provides real-time feedback to the user based on the user's performance of the exercise. Exercise data are preferably received at high frequency by the electronic device 400 and/or accessory 1 are processed in real time in the processing unit 104 to generate output data. Such output data pertain to the user's execution of the exercise, for example the force exerted, the motion smoothness, motion speed and/or motion agility. The processor 140 compares the input data to a standard range of parameters for a specific exercise. In cases where the user input data lie outside said range, an instruction for correction of the exercise may be displayed through the GUI or the accessory.

The real-time feedback loop therefore includes the user performing the exercise and generating input data C, D, the processing unit 104 receiving the input data X, the processing unit calculating output data in real time and conveying said output data Y, Z, for example in form of instructions, through the electronic device and/or the accessory to the user in real time.

The standard range may be a predetermined range, which may be associated with a user profile. In a preferred option, the standard range for a given exercise is obtained as part of a calibration step. An artificial intelligence (AI) algorithm, such as a supervised machine learning algorithm, is preferably employed to determine the standard range. The so determined standard range corresponds to a safe training range for an individual user. In addition, and if desired, the standard range may be dynamically adjusted throughout a training program.

Optionally, data pertaining to the user and his performance of the training can be stored in a remote server, such as a cloud server.

User data collected during a work-out session may be used to provide a summary of the overall performance, optionally with suggestions regarding possible improvements. User data may also be used to determine and suggest a suitable training program for an individual user. Such training program may be tailored to reach objectives as defined by the user or a supervisor. Stored data may be shared with a supervising trainer, such as a medical professional, a physiotherapist or a physical training instructor, for information and further analysis.

It should be understood that various changes and modifications to the presently preferred embodiment described herein will be apparent to those skilled in the art. Such changes and modifications can be made without departing from the spirit and scope of the present invention and without diminishing its attendant advantages. It is, therefore, intended that such changes and modifications be covered by the appended claims.

The invention claimed is:

1. An accessory for an electronic device for performing physical exercise, comprising:

a housing suitable for holding the electronic device, the electronic device including a graphical user interface, a data interface between the accessory and the electronic device, one or more elastically deformable handle band systems, each comprising a handle and one or more stretchable bands suitable for pulling exercises, wherein the one or more stretchable bands are attached to the housing, such that each of the one or more elastically deformable handle band systems is capable of freely swivelling around its respective attachment point, one or more sensors, including at least a force sensor in the accessory, the force sensor being configured to determine a force exerted by the one or more elastically deformable handle band systems, and a locking fastener suitable for fixing mountable weights to the housing, or magnetic portions of the housing such that mountable weights are capable of being attached magnetically to the housing.

2. A method for adjusting physical exercise to physical capabilities of users with reduced physical capabilities using the accessory of claim 1, comprising through a processor contained in the electronic device or in the accessory determining or receiving an individual user safe training range, wherein the individual user safe range is dynamically refined based on the real time user training data, through a processor contained in the electronic device or in the accessory receiving user training data pertaining to an execution of a training exercise of a user in real time, and based on said user training data calculating corrections in real time through a processor contained in the electronic device or in the accessory and communicating instructions to the user in real time to permit the user to correct his execution of the training exercise such that the training exercise is executed within a safe training range.

3. The method for adjusting physical exercise of claim 2, including determining the safe training range of the user comprising defining a calibration exercise to be performed by the user on the accessory, through a processor contained in the electronic device or in the accessory receiving user calibration data pertaining to the execution of the calibration exercise by the user, through a processor contained in the electronic device or in the accessory defining a user profile based on the user calibration data or refining a predetermined/predefined user profile based on the user calibration data, defining the safe training range based on user calibration data for an individual user profile, which may be the user profile based on the user calibration data or the refined predetermined/predefined user profile based on the user calibration data.

4. The method for adjusting physical exercise of claim 2, wherein instructions for corrections are communicated to the user in respect of each user extremity operating at least one of the one or more elastically deformable handle band systems.

5. The method for adjusting physical exercise of claim 2, wherein instructions for corrections are communicated through the graphical user interface of the electronic device.

6. The method for adjusting physical exercise of claim 2, wherein instructions for corrections are communicated through the electronic device and through the accessory in the form of visual, acoustic and/or tactile cues.

7. A computer program product which contains instructions for performing the method of claim 2, which, when loaded on a computerised system or a computer, allows the computerised system or the computer to perform the method of claim 2.

8. A computer program product which contains instructions for performing the method of claim 2, which, when loaded on a computerised system or a computer, allows the computerised system or the computer to perform the steps of the method of claim 2.

9. The accessory of claim 1, comprising a bidirectional data interface.

10. The accessory of claim 1, each of the one or more elastically deformable handle band systems being pivotably attached on a separate attachment point to the housing.

11. The accessory of claim 1, wherein each of the one or more elastically deformable handle band systems is configured to be elastically pulled.

12. The accessory of claim 1, the one or more elastically deformable handle band system consisting of two elastically deformable handle band systems, wherein a first elastically deformable handle band system is configured to be operated by a left hand of the user and a second elastically deformable handle band system is configured to be operated by a right hand of the user.

13. The accessory of claim 1, wherein the accessory is configured for communicating visual, audio and/or tactile cues to a user.

14. The accessory of claim 1, wherein, in addition to the one or more sensors, the accessory in combination with the electronic device comprises a gyroscope and/or an accelerometer.

15. The accessory of claim 1, wherein the one or more sensors include a heart rate sensor, a pulse sensor, and/or a sensor to determine galvanic skin response or other electrodermal responses, which are preferably comprised in the handles of at least one of the one or more the elastically deformable handle band systems.

16. The accessory further to claim 1, the accessory in combination with the electronic device comprising a processor for receiving real time input data and for generating output data in real time.

* * * * *